US008147284B2

(12) United States Patent
Banks et al.

(10) Patent No.: US 8,147,284 B2
(45) Date of Patent: Apr. 3, 2012

(54) SUBMERSIBLE PROPULSOR UNIT

(75) Inventors: Simon Banks, Derby (GB); John Owen Fowler, Matlock (GB)

(73) Assignee: Rolls-Royce plc, London (GB)

( * ) Notice: Subject to any disclaimer, the term of this patent is extended or adjusted under 35 U.S.C. 154(b) by 226 days.

(21) Appl. No.: 12/314,175

(22) Filed: Dec. 5, 2008

(65) Prior Publication Data

US 2009/0176419 A1 Jul. 9, 2009

(30) Foreign Application Priority Data

Jan. 4, 2008 (GB) ..... 0800075.4

(51) Int. Cl.
*B63H 5/15* (2006.01)

(52) U.S. Cl. ..... 440/67; 415/221

(58) Field of Classification Search ..... 440/67; 415/191, 192, 208.1, 208.2, 209.1, 209.2, 415/209.3, 221; 416/215, 216, 217, 218
See application file for complete search history.

(56) References Cited

U.S. PATENT DOCUMENTS

| | | | | |
|---|---|---|---|---|
| 4,993,977 | A | 2/1991 | Rodler, Jr. | |
| 5,220,231 | A * | 6/1993 | Veronesi et al. | 310/90 |
| 5,252,875 | A | 10/1993 | Veronesi et al. | |
| 5,597,245 | A | 1/1997 | Meyerhoff | |
| 6,572,422 | B2 * | 6/2003 | Kirkwood et al. | 440/67 |
| 2008/0194155 | A1 * | 8/2008 | Gaudin | 440/67 |

FOREIGN PATENT DOCUMENTS

GB 1 323 872 7/1973

OTHER PUBLICATIONS

"Submarine Propulsors"; Rolls-Royce Fact Sheet; 2003.
"Design step-change propels Astute-class submarines"; Rolls-Royce Publication; pp. 10-11.

* cited by examiner

*Primary Examiner* — Lars A Olson
(74) *Attorney, Agent, or Firm* — Oliff & Berridge, PLC

(57) ABSTRACT

A submersible propulsor unit, comprising: a duct defined between a duct hub and a duct wall, the duct having a water inlet and a water outlet, a propeller means rotatably mounted within the duct, and an array of stator vanes extending between the duct hub and the duct wall, wherein the array of stator vanes comprises stator vanes having a first stiffness and stator vanes having a second stiffness.

16 Claims, 4 Drawing Sheets

SUBMERSIBLE PROPULSOR UNIT

This invention relates to submersible propulsor units.

Propulsor units are used on ships or boats to drive the vessel through the water. One known propulsor is known as a ducted propeller, or pumpjet propulsor. This form of propulsor consists of a rotatable rotor mounted within a duct. Stator hydrofoils are located forward or aft of the rotor to impart or remove swirl in the flow through the duct depending on whether they are mounted upstream or downstream of the rotor.

With reference to the diagram of the prior art (shown in FIG. 6), the prior art propulsor units comprise a duct 6 formed either of nickel aluminium bronze (NAB) or a single piece marine grade composite having internal, longitudinally extending stiffeners which limit twisting of the duct. If the duct twists excessively the gap between the tip of the rotor 4 changes giving a greater risk of tip rub.

The duct is mounted to the hub 10 of the propulsor by a circumferentially extending array of stators 8. These are located upstream of the rotor 4 in the diagram of the prior art, but can be located downstream, or two or more arrays may be provided with a selected number upstream and a selected number downstream of the rotor.

The stators have the same external form to present the desired flow field to the rotor such that the propulsor either has improved efficiency, or the wake from the propulsor is reduced.

Each of the stators is formed of NAB that is structurally stiff enough secure the duct and resist twisting caused by the flow of water through the duct. The use of NAB provides a satisfactory solution for conventional propulsors; however, the material has a relatively low strength to density ratio, is high in material costs as well as being heavy.

The stators on conventional propulsors can also vibrate as water flows through the duct to generate periodic frequency responses. These responses, also known as modal responses, can create unwanted noise or vibration throughout the ship or boat structure. Propulsors of this type may be used on large passenger liners and undesirable noise and vibration from the engines can cause discomfort to some passenger. In other applications the modal frequencies may be excited by the rotor at particular shaft rotational speeds. This can give rise to an unwanted noise signature.

It is an object of the present invention to seek to provide an improved propulsor.

According to a first aspect of the invention there is provided a submersible propulsor unit, comprising: a duct defined between a duct hub 10 and a duct wall 6, the duct having a water inlet and a water outlet, a propeller means rotatably mounted within the duct, and an array of stator vanes extending between the duct hub and the duct wall, wherein the array of stator vanes comprises stator vanes having a first stiffness and stator vanes having a second stiffness.

Preferably the vanes having a first stiffness and the vanes having a second stiffness present the same external form to the duct.

Preferably the vanes having the first stiffness are interleaved with the vanes having the second stiffness.

Preferably the vanes having the first stiffness are uniformly interleaved with the vanes having the second stiffness.

The first stiffness is preferably greater than the second stiffness.

Preferably the stator vanes having the first stiffness are formed from metallic material. The metal may be NAB or Steel. Preferably the stiffer vanes have a stiffness of the order 100,000 to 210,000 N/mm^2.

Preferably the second stiffness encompasses a range that is of the order 0.1 to 0.8 times that of the higher stiffness vanes. An all carbon fibre reinforced resin stator tends to the higher end of the range and as you increase the amount of glass the stiffness is reduced.

The stator vanes having the second stiffness may be formed from composite. Preferably the composite is a fibre reinforced resin.

Embodiments of the invention will now be described by way of example only, with reference to the accompanying drawings, in which.

Figure 1:
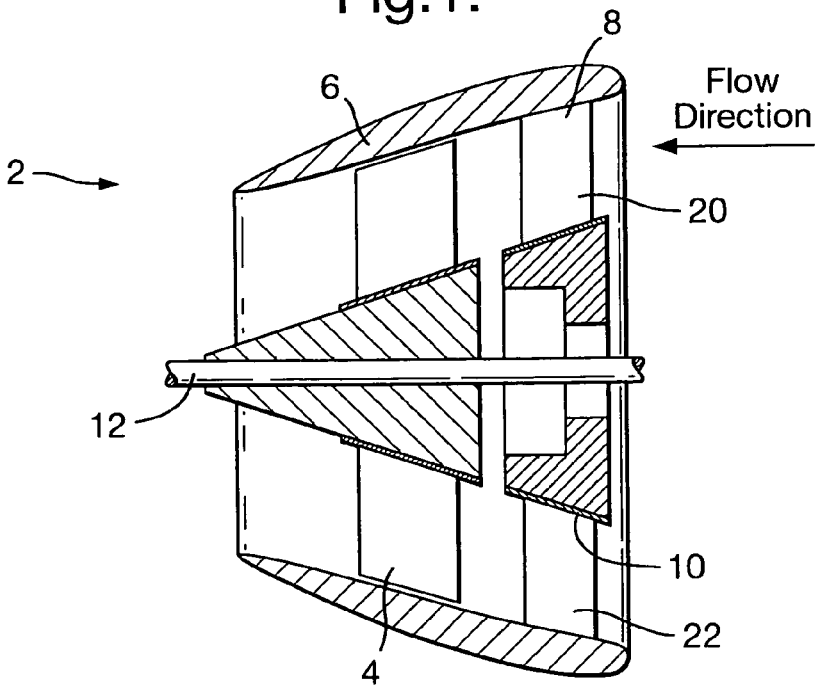
FIG. 1 depicts a cross-sectional view of part of a marine propulsor.

FIG. 1 depicts a cross-section of a marine propulsor commonly known as a ducted propeller or pumpjet propulsor. The pumpjet propulsor has similarities with the pumpjet propulsor of the prior art and where possible the diagrams have been given the same reference numerals for the same components as in the prior art. In the embodiment described the propulsor is attached to a submarine though it will be appreciated that with minor modifications it may be attached to surface vessels.

The propulsor 2 comprises a propeller 4 within a duct 6, which has a static row of stator vanes 8 at the inlet to impart swirl. The swirl imparted presents a swirling flow to an array of rotating propeller blades, the swirling flow being cancelled by the rotation of the propeller which allows the wake of the propulsor to be swirl free.

The duct has a marine composite material sandwich construction formed into a one-piece component. The marine composite material offers significant advantages over NAB in terms of improved corrosion resistance, cost and weight. However, the composite materials are structurally less stiff and require longitudinal ribs to achieve the shock strength and manoeuvring rigidity required.

The improved rigidity provided to the duct prevents twisting and deflection that can reduce rotor tip clearances and increase the risk damage caused by contact between the rotor and the duct.

The duct is supported by the array of stators 8, which are secured to a centrebody 10. The centrebody is structurally mounted to the vessel such that thrust generated by the propeller is transmitted through to the vessel to generate motion of the vessel through the water. The centrebody 10 is ring shaped and the stators are mounted in an array extending about the ring and extend radially outwards and are connected at their tips by the surrounding single-piece duct.

A shaft 12 extends through the hub 10 carrying the stator ring and propeller blades 4 are functionally mounted to the shaft. Rotation of the shaft generates a corresponding rotation of the propeller blades.

Each of the stators has an identical external form to the other stators. The hydrodynamic loading created by each stator and presented to the propeller is the same. In accordance with the invention, however, the stators are constructed differently to offer an improved propulsor.

A proportion of the stators within the array have high stiffness, whilst the remaining stators have a relatively lower stiffness. The high stiffness stators may be formed conventionally from NAB or from steel and are provided in sufficient number and strength to satisfy the structural requirements of the propulsor. Steel is particularly preferred as it has nearly twice the stiffness of NAB.

The low stiffness stators are formed of a moulded laminated composite. Such composites are made from a series of fibre impregnated sheets that are laminated together and subsequently press moulded to the desired shape. Such components have been used as aerofoil components e.g. in gas turbine engines, but are not usually used in marine applications due in part to the significantly greater density of water over that of air that will induce high deflection in these stators and which increases the complexity of the design process.

The composite stators are much less dense than either steel or NAB. Steel has a density of the order 7800 kg/m^3 and NAB a density of between 7600 kg/m^3 and 7700 kg/m^3. By contrast the composite material, which may be selected from a group comprising, but not limited to: glass, carbon/glass, or carbon fibre reinforced polymer composite, where the polymer can be polyester, vinyl-ester, epoxy, phenolic, or a whole range of thermoplastic resins. The particularly preferred composite is a glass/carbon fibre epoxy material which has a typical density of approximately 2200 kg/m^3. This means that each stator is significantly lighter than a corresponding steel or NAB stators giving a large overall reduction in the weight of the propulsor.

Because the composite stators lack rigidity they cannot be used solely to support the duct body 6 as their flexibility will not sufficiently resist twisting of the duct. When the vessel on which the propulsor is mounted changes direction additional fluid flow forces are applied to the outside of the duct which results in a stress in the stators which augments the normal "straight ahead" stress. The stators will twist to mitigate against the stress and can bring the duct wall into contact with the rotors.

Figure 2:
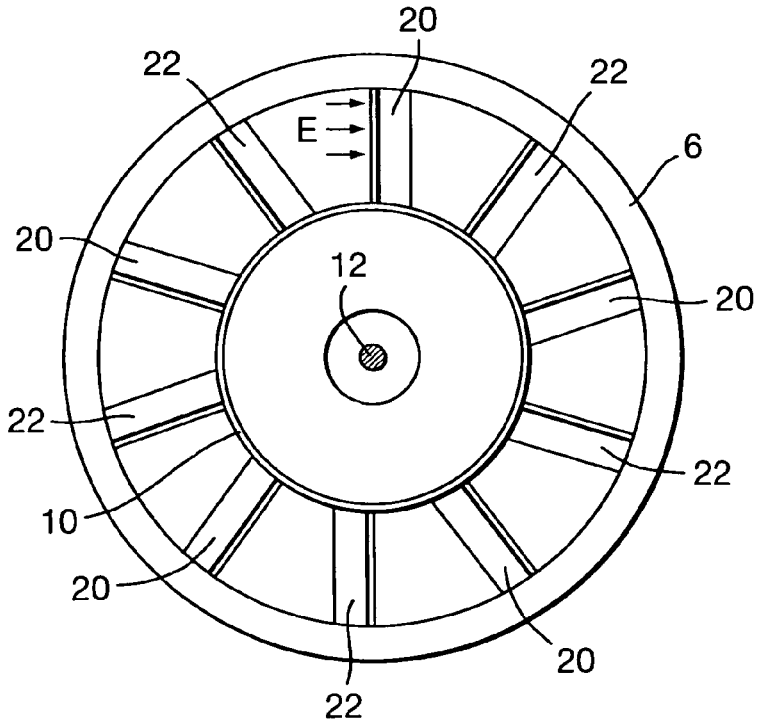
FIG. 2 depicts a view of the stator vanes of the propulsor of FIG. 1 looking in the flow direction.

In accordance with the invention, as depicted in FIG. 2, the stator array is arranged with the stiffer stator blades A interleaved by the less stiff stator blades B. Preferably the blade types are distributed evenly around the array to achieve uniform global stiffness properties in the duct. As each stator has the same external form, each stator will experience the same hydrodynamic loading E as the result of flow of water over the hydrofoil surfaces.

As mentioned above, for a typical ducted propeller system the free-tip (cantilever) deflections of the more flexible stators caused by the hydrodynamic loading E would create large stress and strains within the flexible stators were it not for the presence of the stiffer, interleaved stators. The duct between the adjacent stiff stators transfers load circumferentially between the adjacent stiff stator tips resulting in a significantly lower stresses and strains in the flexible stators when compared with the stiff stators.

The stiff stator blades between them carry the majority of the entire structural requirements of the propulsor with the flexible stators completing the hydrodynamic form. Lower stresses and strains in the flexible stators reduce the likelihood of failure of these components. The use of stiffer stators minimise the effect of failure of the flexible stators in service for any reason e.g. manufacturing deficiency, shock/impact. Additionally, the reduced structural loading of the flexible stators allows simpler methods to be adopted to attach these components. In the preferred embodiment the composite is embedded into a slot in the centrebody 10 whilst the stiffer stators are conventionally bolted or otherwise mounted to the centrebody.

Figure 3:
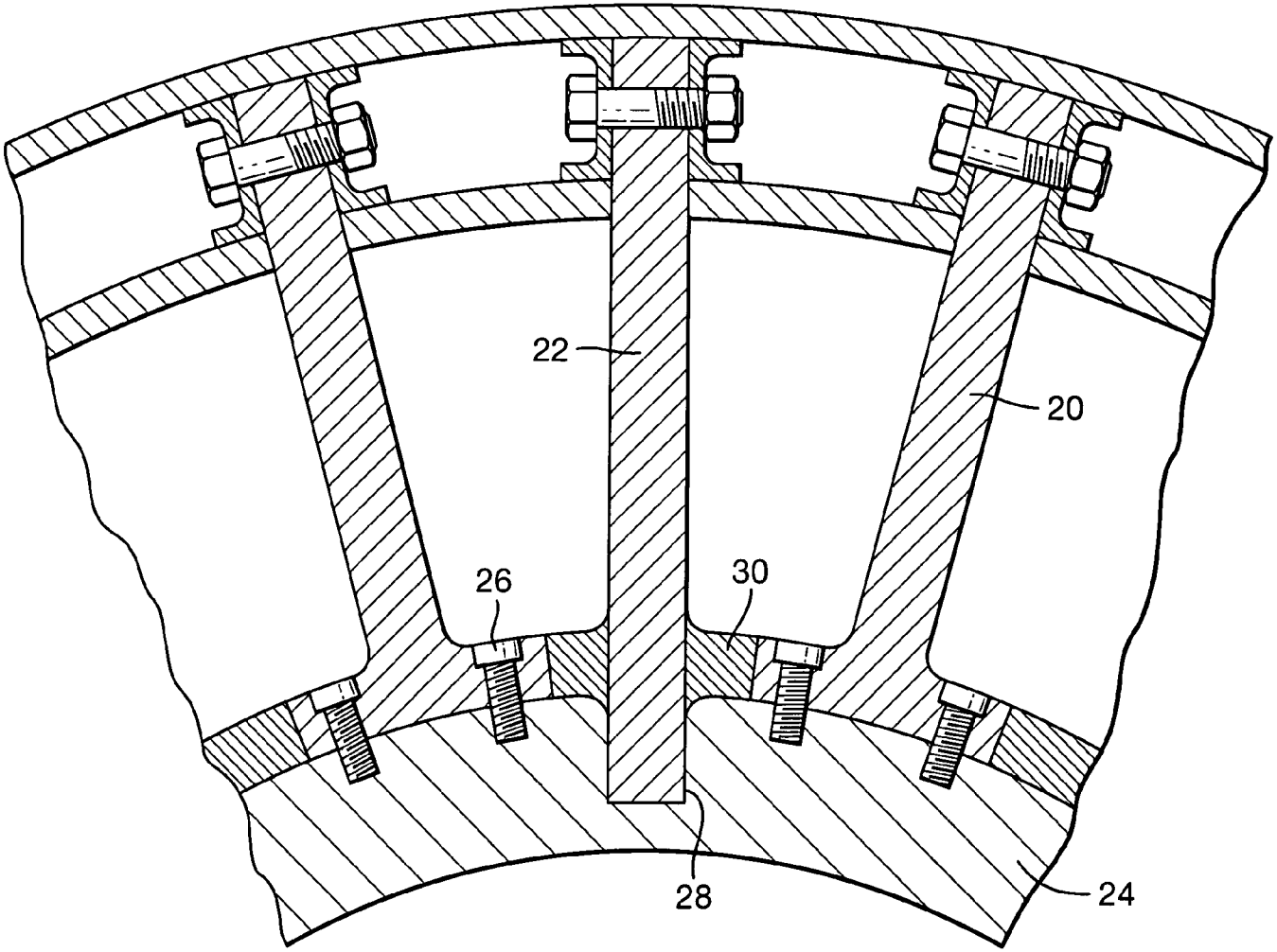
FIG. 3 depicts an arrangement for securing more flexible vanes in a propulsor.
Figure 4:
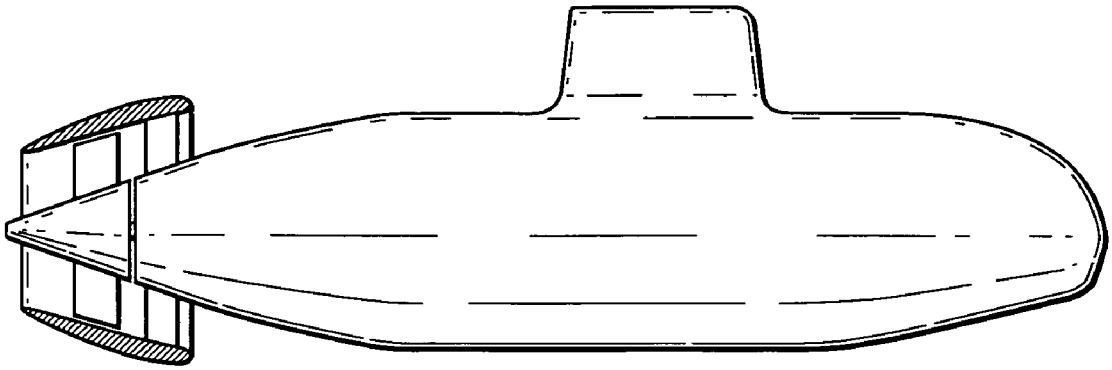
FIG. 4 depicts a marine propulsor of the invention mounted to a boat.
Figure 5:
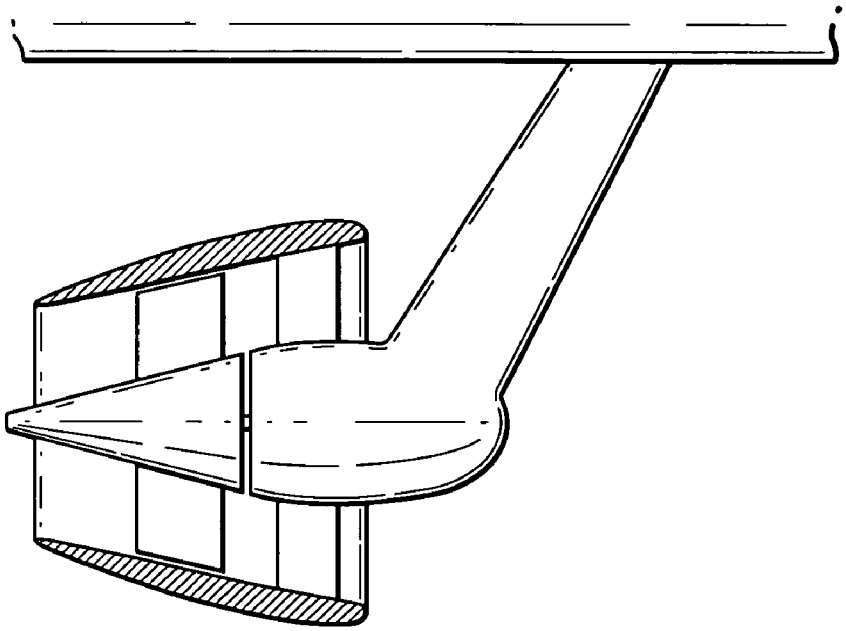
FIG. 5 depicts a marine propulsor of the invention mounted to a ship.
Figure 6:
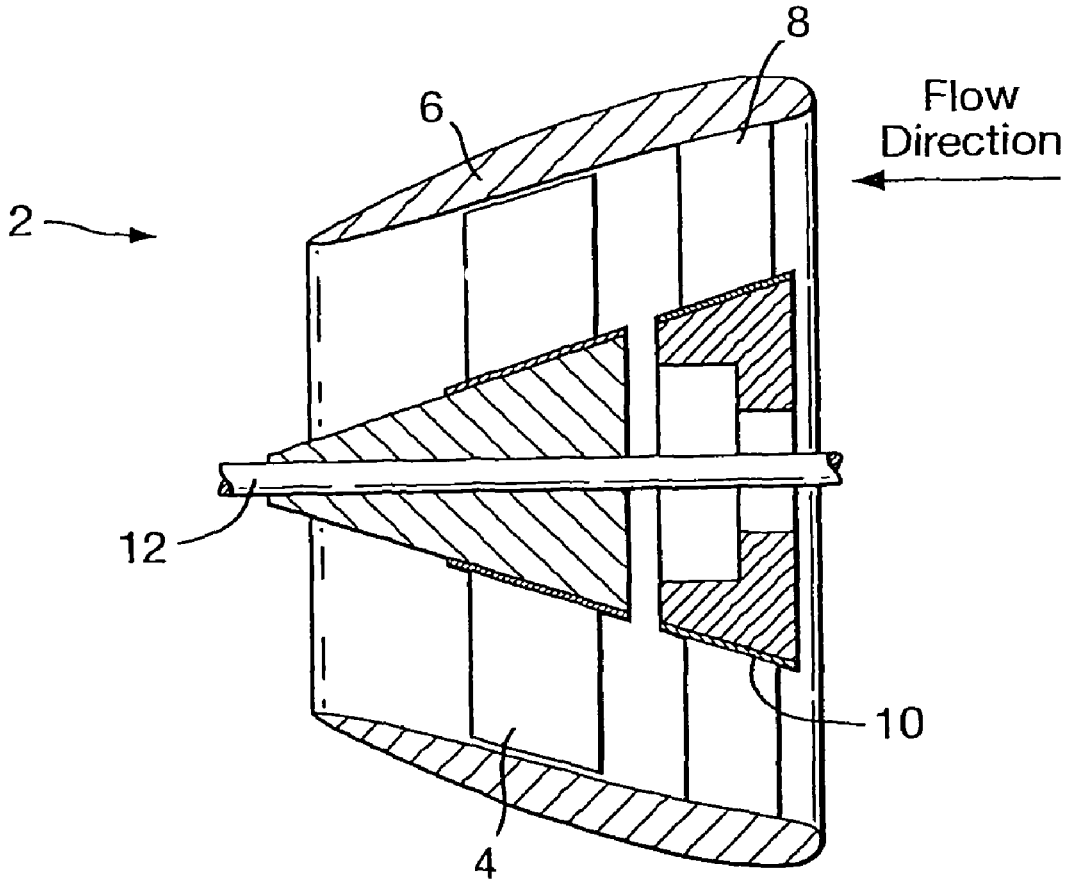
FIG. 6 depicts a cross-sectional view of part of a marine propulsor of the prior art.

An exemplary arrangement is shown in FIG. 3. The stator ring 8 has high stiffness stators 20 interleaved with the less stiff composite stators 22. The high stiffness stators are securely fastened to the mounting ring 24, or centrebody by an appropriate fastening means e.g. bolt fasteners 26.

Slots 28 are formed in the centrebody 24 into which the composite vanes are inserted. A filler such as a resinous adhesive may be used to help secure the stator to the centrebody and neighbouring vanes and to present a smooth profile to the water flowing through the propulsor.

The introduction of the composite stator vanes provides a significant weight and material saving to the propulsor.

By effectively isolating the structural requirements for the flexible stator vanes from their hydrodynamic shape requirements a hybrid construction can be adopted which utilises modern materials without compromising structural or signature performance.

The relative proportion and location of stiffer stators to the more flexible stators can be varied for each vessel application to provide the necessary global system properties.

The stiffness of the flexible stators can also be varied for a given situation by changing its material of manufacture, or providing stiffening rods. Beneficially, the overall modal frequency of the duct/stator system can be tuned to avoid detrimental noise signatures emanating from the propulsor.

Vibration from the engine may also be controlled through the use of the tuned composites giving rise to a smoother operation. This is of particular benefit to the luxury liner market where comfort is of particular importance. In other applications it may be desirable to avoid resonance generated at particular operating speeds. By selecting an appropriate stiffness of the composite blade the signature of the propulsor can be tuned.

We claim:

1. A submersible propulsor unit, comprising:

a duct defined between a duct hub and a duct wall, the duct having a water inlet and a water outlet; and a propeller means rotatably mounted within the duct, and an array of stator vanes extending between the duct hub and the duct wall, wherein the array of stator vanes includes stator vanes having a first stiffness and stator vanes having a second stiffness, and the first stiffness is greater than the second stiffness.

2. A propulsor unit as claimed in claim 1, wherein the vanes having a first stiffness and the vanes having a second stiffness present the same external form to the duct.

3. A propulsor unit as claimed in claim 1, wherein the vanes having the first stiffness are interleaved with the vanes having the second stiffness.

4. A propulsor unit as claimed in claim 3, wherein the vanes having the first stiffness are uniformly interleaved with the vanes having the second stiffness.

5. A propulsor unit as claimed in claim 1, wherein the stator vanes having the first stiffness are formed from metallic material.

6. A propulsor unit as claimed in to claim 5, wherein the metal is NAB or Steel.

7. A propulsor unit as claimed in claim 5, wherein the stator vanes having the second stiffness are formed from a composite material.

8. A propulsor unit as claimed in claim 1, wherein the first stiffness is between 100,000 and 210,000 N/mm^2.

9. A propulsor unit as claimed in claim 8, wherein the second stiffness is between 0.1 and 0.8 of the first stiffness.

10. A propulsor unit as claimed in claim 1, wherein the stator vanes having the second stiffness are formed from composite.

11. A propulsor unit as claimed in claim 10, wherein the composite is a fibre reinforced resin.

12. A waterborne vessel comprising a propulsor unit according to claim 1.

13. A submersible propulsor unit, comprising:

a duct defined between a duct hub and a duct wall, the duct having a water inlet and a water outlet, a propeller means rotatably mounted within the duct, and an array of stator vanes extending between the duct hub and the duct wall, wherein the array of stator vanes includes first stator vanes formed of metallic material and second stator vanes formed of a composite material.

14. A propulsor unit as claimed in claim 13, wherein the first stator vanes and the second stator vanes present a same external form to the duct.

15. A propulsor unit as claimed in claim 13, wherein the first stator vanes are interleaved with the second stator vanes.

16. A propulsor unit as claimed in claim 15, wherein the first stator vanes are uniformly interleaved with the second stator vanes.

* * * * *